US005294354A

United States Patent [19]

Papke et al.

[11] Patent Number: 5,294,354

[45] Date of Patent: Mar. 15, 1994

[54] COMBINING DISPERSANT VISCOSITY INDEX IMPROVER AND DETERGENT ADDITIVES FOR LUBRICANTS

[75] Inventors: Brian L. Papke; Isaac D. Rubin, both of Wappingers Falls; John Castrogiovanni, Jr., Milton, all of N.Y.

[73] Assignee: Texaco Inc., White Plains, N.Y.

[21] Appl. No.: 893,627

[22] Filed: Jun. 5, 1992

[51] Int. Cl.[5] ..... C10M 135/10; C10M 133/58

[52] U.S. Cl. ..... 252/18; 252/33; 252/50

[58] Field of Search ..... 252/50, 18, 33

[56] References Cited

U.S. PATENT DOCUMENTS 4,146,489 3/1979 Stambaugh ..... 252/50

4,502,971 3/1985 Robson ..... 252/33.3

4,715,975 12/1987 Kapusciniski et al. ..... 252/50

4,863,623 9/1989 Nalesnik ..... 252/50

4,886,611 12/1989 Kapusciniski et al. ..... 252/50052940145

4,981,603 6/1991 Demange ..... 252/33

OTHER PUBLICATIONS

Smalheer and Smith, "Lubricant Additives", 1967.

*Primary Examiner*—Ellen M. McAvoy

*Attorney, Agent, or Firm*—James J. O'Loughlin; Henry H. Gibson

[57] ABSTRACT

Lubricants with enhanced viscosities are made from additives by combining dispersant viscosity index improver, like dispersant nitrogen-substituted polyolefins, and detergent, like select overbased, oil-soluble, metal salts, before adding dispersant package.

11 Claims, 3 Drawing Sheets

COMBINING DISPERSANT VISCOSITY INDEX IMPROVER AND DETERGENT ADDITIVES FOR LUBRICANTS

BACKGROUND OF THE INVENTION

1. Field of the Invention

This invention concerns lubricants and methods for their production. More particularly, lubricating oils having enhanced viscosity properties are made by combining certain dispersant viscosity index improver and detergent lubricant additives.

2. Description of Related Information

Lubricants plan an essential role in many areas, particularly in the transportation industry. Large amounts of inexpensive lubricants are needed to keep transportation vehicles running smoothly. Mineral oils are relatively inexpensive and have been used effectively as lubricants. The use of mineral oils is, however, curtailed by the limited performance characteristics of mineral oils over the full range of temperature and conditions under which lubricants are used, such as for lubricating engines or other high speed, moving parts. Lubricants often need to have sufficient fluidity, which can be determined by measuring viscosity, over a wide temperature range. For example, engine crankcase lubricant needs to be sufficiently fluid at temperatures well below 0° C. to enable engine start-up in cold weather. Conversely, such lubricant must also have enough viscosity at high temperatures during engine operation to avoid "thinning out", which would result in loss of engine lubrication.

Synthetic oils have been developed which can operate more effectively over a wider range of conditions than mineral oils alone. Various additives have also been developed which supplement and extend lubricating oil performance. Additives called viscosity index, or "VI", improvers or modifiers, are designed to improve the viscosity of lubricants, such as by increasing, or extending, the viscosity of the lubricant at higher temperatures. For example, U.S. Pat. No. 4,863,623 (Nalesnik) describes VI improvers which are polyolefins grafted with carboxylic groups derivatized with amino-aromatic polyamine. This VI improver also provides dispersancy and anti-oxidant properties.

These and other additives, like dispersants, detergents, anti-foamants, various inhibitors and more, are used to expand the utility of lubricants for differing applications. When used in combination, the additives and lubricants can interact in ways that change the properties and usefulness of the lubricant composition. For example, some dispersants and detergents have limited compatibility, such as disclosed in U.S. Pat. No. 4,502,971 (Robson) which describes mixtures of dispersants and magnesium detergents having increased viscosity which is reduced by prereacting dispersant with alkali metal salt. Similarly, U.S. Pat. No. 4,981,603 (Demange) describes a process for improving the compatibility of dispersants and magnesium detergents by premixing dispersant, detergent and solvent to eliminate haze and sediment.

Synthetic oils and additives, however, add significantly to the expense of lubricants. It would therefore be highly desirable if a lubricant can be made which maximizes the use of relatively inexpensive, mineral oils and minimizes the use of more expensive, synthetic oils and additives, and which also gives more effective lubricant performance, such as better fluidity, over a wide range of temperatures and conditions.

SUMMARY OF THE INVENTION

This invention concerns a process for making a lubricant composition. The process involves combining dispersant VI improver with detergent to make a premix. The dispersant VI improver is a polyolefin of ethylene, $C_{3-20}$ α-moloolefin, and optionally polyene, having a number average molecular weight of at least about 10,000, which is grated with ethylenically unsaturated, nitrogen-containing, heterocyclic compound. The detergent is an overbased, oil soluble, metal salt which interacts with the viscosity index improvers to give increased lubricant viscosity at high temperatures. Lubricating oil and dispersant package are then combined with the premix to make a lubricant composition with enhanced viscosification.

Lubricant compositions made by such processes are also provided.

Viscosifying composition comprising the premix in lubricating oil and which is essentially free of low molecular weight dispersant and having enhanced lubricant viscosification properties are also provided.

BRIEF DESCRIPTION OF THE DRAWINGS

The accompanying drawings present graphs showing viscosity performance properties of this invention.

DETAILED DESCRIPTION OF THE INVENTION

Figure 1:
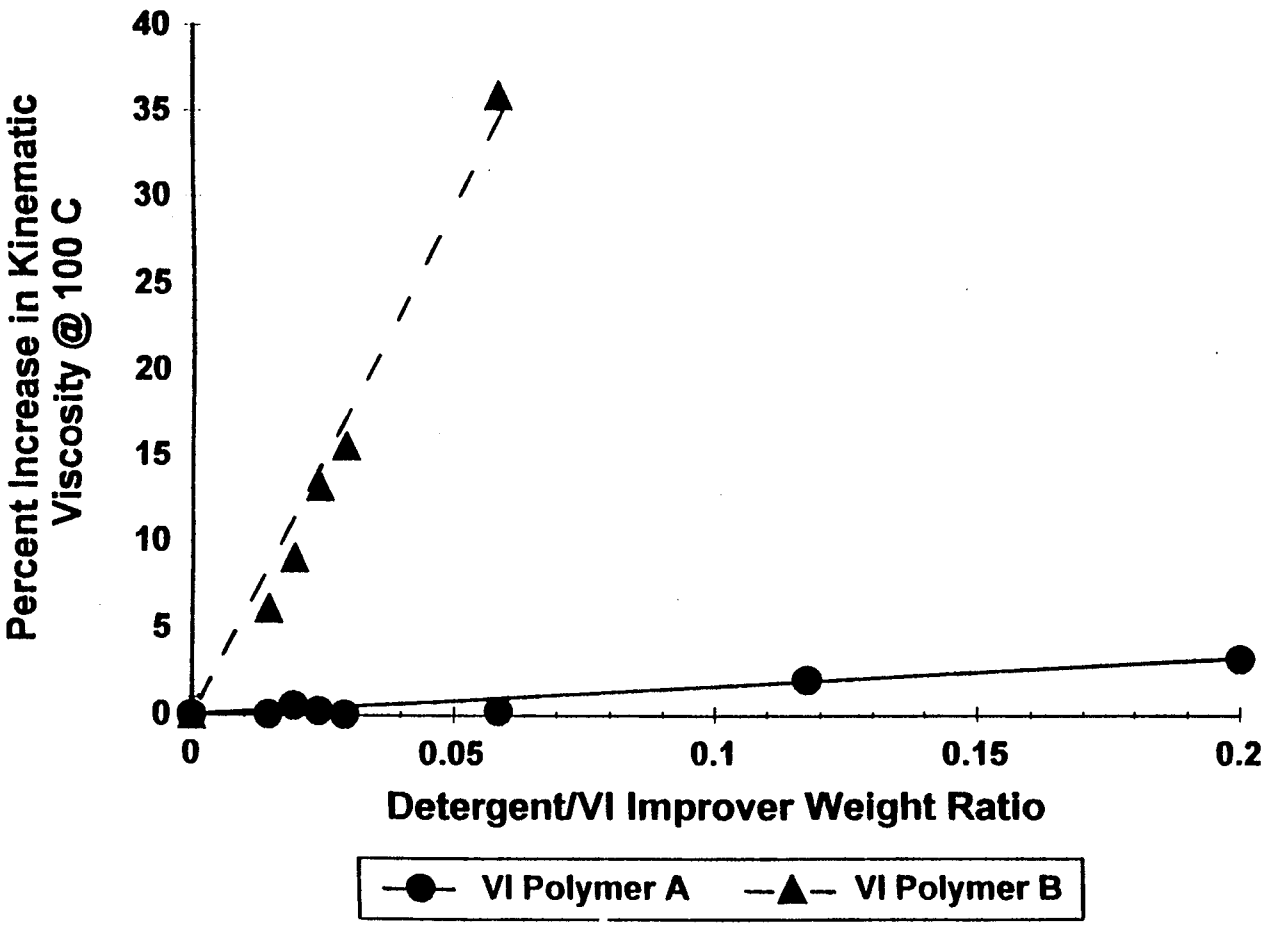

This invention enables the production of lubricants based on inexpensive mineral oils having enhanced viscosities using lower amounts of additives. These improvements are provided by a simple and inexpensive procedure involving the precombination of particular additives.

The lubricant composition comprises, and preferably consists essentially of, four parts: (1) lubricating oil; (2) VI improver; (3) detergent and (4) dispersant package, which may have lubricant additives other than dispersant.

The lubricating oil may be any, including known, material which has lubricating properties. The lubricating oil may be natural or synthetic, as well as mixtures of each. The lubricating oil may be unrefined compounds obtained directly from a natural or synthetic source, refined compounds from natural or synthetic sources which are treated in one or more purification steps, such as to improve one or more properties, or re-refined compounds from the reprocessing of used lubricants, as well as mixtures of unrefined, refined and/or re-refined compounds. Typical natural lubricating oils include, among others, one or mixtures of the following: liquid petroleum oils and hydrorefined, solvent-treated or acid-treated mineral lubricating oils, including paraffinic and/or naphthenic compounds such as N-100 Pale Oil from Texaco Inc. and SNO-100 and SNO-150 from Texaco Inc.; and the like. Typical synthetic lubricating oils include, among others, one or mixtures of the following: polyalphaolefins such as EMERY® 3004 and 3006 PAO Basestocks from Quantum Chemical Corp. and MOBIL® SHF-42 from Mobil Chemical Co.; diesters such as EMERY® 2960 and 2971 Synthetic Lubricant Basestocks from Quantum Chemical Corp. and MOBIL® Esters DB-41 and DB-51 from Mobil Chemical Co.; polyol esters, such as made by reacting dicarboxylic acids, glycols and either monobasic acids or monohydric alcohols, like EMERY® 2936 Synthetic Lubricant Basestocks from Quantum Chemical Corp. and MOBIL® Ester P-24 from Mobil Chemical Co.; silicone oils; and the like.

The viscosity improver is a polyolefin having substituents giving the polymer dispersancy properties, generally including the ability to maintain materials suspended in lubricant compositions thereby reducing undesirable precipitation or deposition. The polyolefin is a graft co-, ter- or higher polymer generally prepared by polymerizing ethylene, $C_{3-20}$ α-monoolefin and optionally polyene monomers. The polyolefin may optionally contain other repeating units, such as derived from other ethylenically unsaturated compounds, to the extent they do not significantly diminish the properties of the polyolefin as used in this invention. Typical α-monoolefins include, among others, one or mixtures of the following: propylene, 1-butene, 1-pentene, and so on. A preferred α-monoolefin is propylene.

The optional polyene is generally one or more non-conjugated diene or triene. Dienes will typically have from about 5 to about 14 carbon atoms and may be acyclic or cyclic, including bicyclic. Typical dienes include, among others, one or mixtures of the following: 1,4-hexadiene; 1,4-cyclohexadiene; dicyclopentadiene; 5-ethylidene-2-norbornene; 5-methylene-2-norbornene; 1,5-heptadiene; 1,6-octadiene; and the like. A preferred diene is 1,4-hexadiene. Trienes, which have at least two non-conjugated double bonds, typically have up to about 30 carbon atoms. Typical trienes include, one or mixtures of the following: 1-isopropylidene-3a,4,7,7a-tetrahydroindene; 1-isopropylidenedicyclopentadiene; dehydroisodicyclopentadiene; 2-(2-methylene-4-methyl-3-pentenyl) [2.2.1]bicyclo-5-heptene; and the like. The polyene reactants provide more complex polymer structures, often designated as interpolymers, which can contain crosslinks within and/or among the polyolefin molecules.

The polyolefin may be obtained from any suitable, including known, source, or may be made by any effective, including known, procedure. Preferred polyolefins include those available as TLA-510A, TLA-525 and TLA-6900 from Texaco Chemical Co.

The ethylenically unsaturated, nitrogen-containing, heterocyclic compound which is grafted onto the polyolefin may be one or mixtures of compounds having at least one ethylenic unsaturation, i.e.

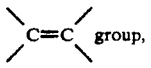

group, and at least one nitrogen-containing heterocyclic group. Typical ethylenically-unsaturated, nitrogen-containing, heterocyclic compounds include, among others, one or mixtures of the following: N-vinyl lactams, like N-vinyl pyrrolidones or N-vinyl piperidones, such as N-vinyl pyrrolidone, N-(1-methylvinyl) pyrrolidone, N-vinyl-5-methyl pyrrolidone, N-vinyl-3,3-dimethyl pyrrolidone, N-vinyl-5-ethyl pyrrolidone, N-vinyl-4-butyl pyrrolidone, N-ethyl-3-vinyl pyrrolidone, N-butyl-5-vinyl pyrrolidone, 3-vinyl pyrrolidone, 4-vinyl pyrrolidone, 5-vinyl pyrrolidone and 5-cyclohexyl-N-vinyl pyrrolidone; vinyl (alkyl) pyridines such as 2-vinyl-5-ethyl pyridine; 2-methyl-5-vinyl pyridine, 2-vinyl-pyridine, 3-vinyl-pyridine, 4-vinyl-pyridine, 3-methyl-5-vinyl-pyridine, 4-methyl-2-vinylpyridine, 4-ethyl-2-vinylpyridine and 2-butyl-5-vinylpyridine; and the like. N-vinyl pyrrolidone is preferred.

The ethylenically-unsaturated, nitrogen-containing compounds may be grafted onto the polyolefin backbone by any suitable, including known, manner. For example, the compound may be grafted onto the backbone by a thermal process, such as the "ene" process, by grafting, such as in solution or solid form, using a free-radical initiator, or any other manner for grafting the compound onto the polymer.

The polyolefin VI improver is a polymer which can have a structure made of the repeating units as shown in Formula 1, or like material.

VI Improver

Formula 1.

$$(-CH_2CH_2-)_a(-\underset{\displaystyle R}{\underset{|}{C}}HCH_2-)_b(-\underset{\displaystyle R_{ene}}{\underset{|}{C}}HCH_2-)_c(-\underset{\displaystyle R'}{\underset{|}{C}}H\underset{\displaystyle R_g}{\underset{|}{C}}H-)_d$$

In Formula 1, the average proportion of repeating units is given by the variables a, b, c, and d which total 100 mole percent. The amount of ethylene repeating units, given by a, is generally from about 15 to about 85, preferably from about 25 to about 80, and most preferably from about 55 to about 80, mole percent. The amount of higher alkylene repeating units, given by b, is generally from about 15 to about 85, preferably from about 20 to about 75, and most preferably from about 20 to about 45, mole percent. The amount of optional polyene repeating units, given by c, is generally from 0 to about 15, and if present is preferably from about 0.1 to about 10, and most preferably from about 0.2 to about 5, mole percent. The amount of repeating units containing one or more dispersancy substituents, given by d, is any amount which provides the polymer with dispersant properties and is generally from about 0.1 to about 15, preferably from about 0.2 to about 10, and most preferably from about 0.2 to about 5, mole percent.

In Formula 1, each R group is independently $C_{1-18}$ alkyl, and is derived from the $C_{3-20}$ α-monoolefin reactant. Typical R groups include, among others, one or more of the following: methyl, ethyl, and so on. R is preferably methyl. Each $R_{ene}$ group is independently $C_{2-30}$ hydrocarbenyl, or a hydrocarbyl or hydrocarbenyl crosslink to another repeating unit of the same or different polyolefin molecule and is derived from polyene reactant, if any. The term "hydrocarbenyl" is used to mean a hydrocarbyl group containing one or more ethylenic unsaturations. The term "hydrocarbyl" is used to mean a group having hydrogen and carbon atoms. The hydrocarbyl may be cyclic or acyclic, including straight- or branched-chain, saturated or unsaturated, including aromatic, and may be unsubstituted or substituted with other elements, such as oxygen, or functional groups, including polar substituents. Typical $R_{ene}$ groups include, among others, the side chain portion of any polyene-based segment of the polyolefin, such as those derived from the typical dienes and trienes described previously, including those which crosslink with other polyolefin segments, and the like. Each R' group is independently hydrogen, R or $R_{ene}$ depending on which kind of repeating unit is grafted.

Each $R_g$ in Formula is independently a grafted substituent made by grafting the ethylenically unsaturated, nitrogen-containing, heterocyclic compound onto the polyolefin. $R_g$ groups are attached to the polyolefin backbone through an ethylene segment and have a nitrogen-containing heterocyclic group. Typical $R_g$ groups include, among others, one or mixtures of the reaction products of the typical ethylenically-unsaturated, nitrogen-containing, compounds described previously, such as N-heterocyclic substituted aminoalkylenes, and preferably N-pyrrolidonyl aminoethylene.

The sequence of repeating units in the polyolefin is not critical. The ethylene, $C_{3+}$ alkylene, and any alkenylene, may be present in any order or configuration, such as in blocks or randomly, provided, however, that the polyolefin is soluble in the lubricant, which may limit the extent of block configuration if it results in gel formation or insolubility. The location of the graft substituents is also not critical. The grafts are typically randomly distributed along the polyolefin backbone. The particular repeating structures shown in Formula 1 are only illustrative. Corresponding isomers are also intended.

The amount of dispersancy substitution is not narrowly critical so long as a sufficient amount of dispersancy substituents are present to give the polyolefin dispersancy properties. Generally, the percentage of grafts containing dispersancy substituent can range from about 40 to 100, preferably from about 70 to about 100, and most preferably from about 90 to about 100, percent.

The molecular weight of the polyolefin must be sufficient to provide viscosity improver properties when added to lubricant or other compositions. Generally, the number average molecular weight of the polyolefin is at least about 10,000, preferably from about 20,000 to about 500,000.

The detergent is an overbased, oil-soluble, metal salt which provides enhanced lubricant viscosification when premixed with the VI improver. Any, including known, overbased, oil-soluble, metal salt giving viscosity enhancement, which is useful as a detergent in lubricant composition may be used. The term "overbased" means that the compound has a stoichiometric excess of base beyond the amount required to neutralize the acid component in the detergent. The detergent is a salt complex which can have a structure as shown in Formula 2, or like material.

Detergent $$(M^{+v}(OH)_v)_m(M_{3-v}^{+v}CO_3^{=})_n(M^{+v}Y_v^{-}) \qquad \text{Formula 2.}$$

In Formula 2, $M^{+v}$ is an alkali or alkaline earth metal cation, having a valence, given by v, of 1 or 2. Typical M cations include among others, some or mixtures of the following: magnesium, sodium, barium and, preferably, calcium. $Y^-$ is an oil-soluble anion. Typical Y include, among others, one or mixtures of the following: alkaryl sulfonates such as sulfonated, alkyl-substituted, aromatic hydrocarbons having from about 9 to about 70 or more carbon atoms, like TLA-1421 from Texaco Chemical Co., LUBRIZOL® 6477 from Lubrizol Corp., E-611 from Ethyl Corp., and AMOCO® 9243 from Amoco Chemical Co.; alkyl salicylates; alkyl phenates; sulfurized alkyl phenates; naphthenates, and the like. Y is preferably a mixture of monoalkylaryl and dialkylbenzene sulfonates. The detergent is said to be overbased when the sum of m+n is more than about 0.5. The amount of overbasing may vary depending upon which cation and anion are used. For example, the amount of overbasing for alkaryl sulfonates generally ranges from above 0.5 up to about 30, preferably from about 5 to about 20, and most preferably from about 8 to about 12. The detergent can have a Total Base Number (TBN), defined as the milligram equivalents of potassium hydroxide per gram of product, typically ranging from about 100 to about 500.

The detergent may be provided in any suitable form, such as in diluent, including mineral oil or the like, typically at concentrations of from about 30% to about 60%, preferably from about 45% to about 55%.

The VI improver is combined with the detergent to make a VI improver/detergent premix, using any effective, including known, procedure for combining such materials. Typically, the VI improver and detergent are combined by simply mixing them together. Generally one or both materials are in the form of a solution in a solvent medium in which the VI improver and detergent are soluble, like mineral oil, and preferably with heating to make a premix solution. Preferably, no additional solvent or diluent is added during the premix step since it is generally not necessary and may result in reduction or less of enhanced viscosification properties provided by the premix. The initial solvent or medium may be any effective, including known, material in which the VI improver and detergent are soluble. Typical solvents include, among others, one or mixtures of the following: lubricating oils as described, including as preferred, previously; and the like. The amount of solvent is generally at least an amount sufficient to give a solution of VI and detergent. Preferably, sufficient solvent is provided, such as may be added before or while combining the VI improver and detergent, to give a premix solution having a viscosity which is easy to handle. Additional solvent acts as diluent by reducing the viscosity of the premix solution to desirable levels. Typically, the concentration of VI improver and detergent in the solvent is from about 5% to about 100%, preferably from about 40% to about 80%, and most preferably from about 60% to about 70%.

The relative amount of VI improver to detergent in the premix may be any amount effective at producing enhanced lubricant viscosification. The relative weight ratio of VI improver to detergent is generally at least about 1:1, preferably from about 7:1 to about 125:1, and most preferably from about 10:1 to about 60:1.

The dispersant package contains dispersant and optionally one or more other lubricant additives. The dispersant may be any, including known, material effective as a dispersant for lubricant compositions, such as by suspending oil insoluble materials, as may result from oxidation, in the lubricant to prevent their flocculation, precipitation, deposition, and also sludge formation. Dispersants which are distinct from dispersant VI improvers generally have low molecular weight of up to about 10,000, preferably from about 1,000, to about 8,000, and most preferably from about 2,000 to about 8,000. Typical dispersants include, among others, one or mixtures of the following: alkyl succinimides like the product of oil-soluble, polyisobutylene succinic anhydride reacted with ethylene amine and derivatives thereof like borate salts; polyalkenyl, especially polyisobutenyl, succinimides and derivatives thereof like Mannich phenol coupled glycamides; polyol esters of hydrocarbon-substituted, especially polyisobutenyl, succinic anhydride and derivatives thereof like oxazolines made with disubstituted amino alcohols; and the like. Preferred dispersants include: polyisobutenyl succinimides alone or combined with other lubricant additives.

Dispersant packages generally contain a concentrated mixture of dispersant and any other lubricant additives, except generally the viscosity improver, due to viscosity constraints. Active ingredients in the dispersant package are present in collective amounts of typically from about 2.5% to about 90%, preferably from about 15% to about 75%, and most preferably from about 25% to about 60%, in appropriate proportions, with the remainder being diluent or lubricating oil.

Other materials may optionally be included in the lubricant composition, such as in the dispersant package or separately. These materials include, among others, one or mixtures of the following. Other VI improvers can be added, such as polyolefins like TLA-525 from Texaco Chemical Co., dispersant polyolefins like TLA-7200 from Texaco Chemical Co., polymethacrylates like TLA-374 from Texaco Chemical Co., hydrogenated polyisobutylene star polymers like SHELLVIS® 250 from Shell Chemical Co., and the like. Other detergents can be added, such as oil soluble surfactants including compounds similar to the previously described overbased detergents without overbasing, such as where m+n in Formula 2 is less than or equal to about 0.5; and the like. Corrosion inhibitors can be added, such as any material effective at reducing degradation of metal contacted by the lubricant, like: phosphosulfohydrocarbons, meaning hydrocarbons containing phosphorus and sulfur, such as made by reacting hydrocarbon, such as terpene with phosphorus sulfide using any effective, including known, procedure; borate esters; thiadiazoles such as derivatives of 2,2-dimercapto-1,3,4-thiadiazole and benzotriazoles; and the like. Antioxidants can be added, such as any material effective in reducing lubricant deterioration from oxidation, like: dihydrocarbyl dithiophosphate metal salts; copper salts; aromatic amines like alkylated diphenylamines and phenyl alpha naphthylamine; hindered phenols; alkaline earth metal salts of alkylphenolthioesters like calcium nonylphenol sulfide, barium t-octylphenylsulfides, dioctylphenyl-amine, phosphosulfurized or sulfurized hydrocarbons; and the like. Pour point depressants can be added, such as any material effective at lowering the temperature at which the lubricant flows or can be poured, including: dialkylfumarate vinyl acetate copolymers; polymethacrylates; wax naphthalene; and the like. Anti-foamants can be added, such as any material which reduces lubricant foaming, including: polysiloxanes like silicone oil and polydimethyl siloxane; and the like. Antiwear agents can be added, such as any material effective at reducing the wear of material contacted by the lubricant, including: dihydrocarbyl dithiophosphate metal salts as described previously; borate esters and thiadiazoles as previously described; and the like. Friction modifiers can be added, such as any material influencing the friction characteristics of the lubricant, like: automatic transmission fluids; fatty acid esters and amides; glycerol esters of dimerized fatty acids; and the like. Any other materials useful in lubricant compositions can also be added.

The amount of lubricating oil, VI improver, detergent, dispersant package and any other ingredients in the lubricant composition is generally any effective, including known, amount for each component which is useful in lubricant compositions. Typically, the active amount of each component, based on the weight percent of the lubricant composition totalling 100%, is: from about 0.01% to about 15%, preferably from about 0.01% to about 4%, VI improver; from about 0.01% to about 20%, preferably from about 0.01% to about 3%, detergent; from 0.1 to about 20%, preferably from about 0.1% to about 8%, dispersant; from 0% to about 5%, preferably from about 0.01% to about 1.5% corrosion inhibitor; from 0% to about 5%, preferably from about 0.01% to about 1.5% oxidation inhibitor; from 0% to about 5%, preferably from about 0.01% to about 1.5% pour point depressant; from 0% to about 3%, preferably from about 0.001% to about 0.15% anti-foamant; from 0% to about 5%, preferably from about 0.001% to about 1.5% anti-wear agent; from 0% to about 5%, preferably from about 0.01% to about 1.5% friction modifier; with the balance of one or more lubricating oils.

Viscosifying compositions, wherein dispersant is not essential, comprise the VI improver and detergent and are essentially free of low molecular weight dispersant, meaning that the composition does not contain an amount of low molecular weight dispersant which adversely impacts the performance of the VI improver and detergent combination, such as may be shown by a reduction in high temperature viscosity properties of lubricating compositions containing such additives. The low molecular weight dispersant can be a dispersant as previously described which has a molecular weight of less than about 15,000, preferably from about 1,000 to about 10,000, and most preferably from about 2,000 to about 10,000.

The VI improver/detergent premix may be combined with the lubricating oil by any effective, including known, procedure. Typically, the premix, dispersant package, and any other ingredients, are added to the lubricating oil with stirring. The mixture is usually heated to assist solubilization of the additives in the lubricating oil. Typically, the temperature may range from about 20° C. to about 100° C., preferably from about 20° C. to about 80° C., and most preferably from about 50° C. to about 80° C.

The additives and lubricant compositions can be used wherever lubricants or viscosifiers are useful, such as: in crank case lubricating oils, including for spark-ignited and compression-ignited internal combustion engines; gas engines; turbines; automatic transmission fluids; gear lubricants; metal-working lubricants; hydraulic fluids; other lubricating oil and grease compositions; or any other areas in which the compositions may be useful, such as motor fuel compositions and additives.

Lubricant compositions made by precombining VI improver and detergent have enhanced lubricant viscosification properties. This can be shown by comparing such compositions with the same composition made without precombining the VI improver and detergent. The enhanced viscosification properties may be shown using any one or more procedures for measuring viscosity or other useful means. One procedure which may be used, for example, involves measuring the kinematic viscosity of the composition. Kinematic viscosity, or KV values, can be measured by standard procedures at any suitable temperature, typically 40° C., 100° C. or 150° C., designated as KV-40, KV-100 and KV-150, respectively. The KV values of lubricant compositions of this invention will generally significantly exceed the KV values of the same compositions made without precombining the VI improver and detergent. Lubricant compositions of this invention have enhanced viscosification properties not only by showing increased viscosities at high temperatures, but also by having relatively low viscosity under low temperature conditions. This can be shown by measuring viscosity at, for example, −20° C. or −25° C. using a Cold Cranking Simulator or similar procedure. The Cold Cranking Simulator procedure is used to determine the apparent viscosity of lubricants at low temperatures and at shear rates similar to those at start-up conditions of cold engines.

This viscosification enhancement can be in the form of increased viscosity properties under normal lubricant operating conditions. Viscosification enhancement may be shown by one or more , including known, tests which measure lubricant viscosity at high temperatures. One or more kinds of viscosity increase may be provided, such as in kinematic, high shear or other viscosity properties. High temperatures include any temperature above ambient conditions. High temperature testing is generally conducted at about 40° C. or more, such as at about 100° or 150° C.

Viscosification enhancement occurs when high temperature viscosity is more than the same viscosity measurement of a corresponding composition which differs only in the kind of VI improver or detergent or without their premixing. The amount of viscosity increase is not narrowly critical. Generally, any measurable viscosity increase can be significant. Preferably, high temperature viscosity will be at least about 2%, and frequently from about 5% to about 100% or more, above the corresponding viscosity absent, or differing in, VI improver, detergent, or premixing.

The enhanced viscosification properties produced by this invention are particularly surprising and unexpected in part since the enhancement is not provided by corresponding lubricant compositions in which the viscosity improver is a similar polyolefin but which does not contain dispersancy substituents. Although the practice of this invention is not bound to any particular theory or explanation, it is believed that dispersant polyolefin VI improvers interact with overbased, oil-soluble, metal salt detergent in a manner which promotes viscosification. This may be due to interactions between colloidal particles of the detergent and polar functional groups of the VI polymer which result in chemical and/or physical crosslinking of VI polymer molecules. This would lead to a higher effective VI polymer molecular weight and consequentially higher viscosifying properties. Adding detergent would lead to increased crosslinking and viscosity up to when all the available functional groups on the VI polymer are used. The degree of crosslinking would then diminish with more detergent addition leading to a drop in the level of viscosity enhancement. This interaction can be inhibited or diminished if other additives, such as dispersant, which may competitively interact with the detergent such as by adsorption, are present when the VI improver and detergent are combined, resulting in lower viscosification properties.

The following examples illustrate some embodiments of this invention and are not intended to limit its scope. Examples designated with a "C" are included for comparison. All percentages given in the disclosure and claims are in weight percent, unless otherwise stated.

EXAMPLES

Terms used in the examples have the following meanings:

| TERM | DESCRIPTION |
|---|---|
| Detergent A | An overbased calcium sulfonate detergent, having a base to sulfonate molar ratio of about 12:1 and a nominal TBN of 300, made from a mixture of 55% monoalkylaryl sulfonate and 45% dialkyl $C_{12}$ benzene sulfonate as described by Jao, J. C. and Joyce Witt, in "Solubilization of Methanol by Calcium Alkylarylsulfonates in Hydrocarbon Media", Langmuir, Volume 6, page 949 (1990). |
| Detergent B | A nominal 300 TBN calcium sulfonate, available as Lubrizol ® 6477 from Lubrizol Corp. |
| Detergent C | A nominal 300 TBN calcium sulfonate, available as Lubrizol ® 74 from Lubrizol Corp. |
| Detergent D | A nominal 300 TBN calcium sulfonate, available as E-611 from Ethyl Corp. |
| Detergent E | A nominal 300 TBN calcium sulfonate, available as WITCO ® C-300 from Witco Corp. |
| Detergent F | A nominal 300 TBN calcium sulfonate, available as AMOCO ® 9243 from Amoco Chemical Co. |
| Detergent G | A nominal 300 TBN magnesium sulfonate, available as WITCO ® M-300 from Witco Corp. |
| Dispersant Package A | An additive composition having 58.2% Dispersant A, 17.4% Detergent A, 13.2% zinc dithiophosphate antiwear agent, 4.5% amine antioxidant, 1.8% amine friction modifier, 0.9% copper antioxidant, 0.9% polymethacrylate pour point depressant, 0.1% deemulsifier, and 3.0% Lubricating Oil C. |
| Lubricating Oil A | Naphthenic base oil, available as N-100 Pale from Texaco, Inc. |
| Lubricating Oil B | Paraffinic base oil, available as SNO-100 from Texaco, Inc. |
| Lubricating Oil C | Poly(decene-1) base oil having a viscosity at 100° C. of 4 centistokes, available as EMERY ® 3004 from Quantum Chemical Corp. |
| Lubricating Oil D | Paraffinic base oils mixture of 40 weight percent SNO-100 and SNO-150 from Texaco, Inc., containing 0.5 weight percent of polymethacrylate pour point depressant. |
| VI Improver A | VI improver polymer which is a random copolymer of about a 60:40 molar ratio of ethylene to propylene, having a number average molecular weight of about 80,000. |
| VI Improver B | Dispersant VI improver polymer which is a random copolymer of about a 60:40 molar ratio of ethylene to propylene, having a number average molecular weight of about 80,000 and grafted with 1.5% N-vinyl pyrrolidone. |
| VI Improver C | Dispersant VI improver polymer which is a random copolymer of about a 60:40 molar ratio of ethylene to propylene, having a number average molecular weight of about 80,000 and grafted with 0.8% maleic anhydride and N-phenyl-1,4-phenylenediamine on essentially each graft. |

Unless otherwise indicated, test results given in the examples use the following procedures;

CCS: Cold Cranking Simulator procedure determined by the American Society for Testing and Materials (ASTM) Method of Test D2602 an din the Society of Automotive Engineers (SAE) J300 standard procedures, given in centipoise.

CHSV: Cannon High Shear Viscosity which is the apparent viscosity of a lubricant composition sample determined from measurements of the relationship between pressure drop and flow rate through a capillary tube at 150° C., as describe din the ASTM Method of Test D4624-86, given in centipoise.

KV: Kinematic Viscosity determined by ASTM Method of Test D445 for automatic viscosity measurements, give in centistokes.

Thickening Power: of a VI improver is the increase in viscosity, at a given temperature, for a lubricant composition containing the VI improver, as compared to the same lubricant without the VI improver.

Examples 1C–9: Lubricant with VI Improver/Detergent Premixes

These examples show how to make lubricant compositions of this invention using dispersant VI improver and detergent premixes. The viscosities of lubricant compositions containing such additives are measured and compared with reference materials illustrating the enhanced viscosification properties provided by this invention. All viscosities for these and subsequent examples use the previously described test procedures, unless otherwise indicated.

In Example 1, the viscosity values of Lubricating Oil A are given in Table 1, for comparison. The even-numbered examples, from 2C to 8C, do not contain detergent and are provided for comparison with the corresponding and next higher odd-numbered examples containing detergent. The lubricant compositions, containing various concentrations and types of VI improver and detergent combinations, are listed in Table 1.

In Examples 3C and 5, lubricant compositions are made by weighing 28.75 g. of a solution of about 13 weight percent of the designated VI polymer in Lubricating Oil A as solvent, 4.25 g. of Detergent A and 217.00 g. of Lubricating Oil A, and mixed for 24 hours at 80° C. The detergent is weighed directly on top of the VI improver prior to addition of the lubricating oil. This provides an opportunity for intimate contact between the detergent and the VI polymer in concentrated form at the beginning of the mixing process. These mixtures have 1.5% VI polymer, 1.7% detergent and the balance Lubricating Oil A. In Example 2C and 4C, the procedure is repeated for Examples 3C and 5, respectively, but without detergent. The same procedure is used in Examples 6C through 9, except that the amount of VI polymer is reduced to 1.1%, by using 21.25 g. of the VI improver solution along with 224.5 g. of Lubricating Oil A.

The various compositions and viscosity measurements for Examples 1C through 9 are given in Table 1.

The results in Table 1 can be analyzed in terms of the relative Thickening Power provided by the various types and amounts of VI improver, with or without detergent, and blending procedure. For example, the Thickening Power at 100° C. of the non-functionalized VI improver in Example 2C is 6.4 (10.14 minus 3.74). The Thickening Power of the same VI improver blended with detergent is 6.66 (10.4 minus 3.74), showing only a 4% increase in polymer thickening efficiency. This increase may simply be attributed to the detergent additive itself, as opposed to any significant interaction between the polymer and the detergent. However, the dispersant VI improver in Examples 4C and 5 gives an increase in Thickening Power from 6.33 to 7.54 for the polymer-detergent blend, which is a 19% increase in polymer thickening efficiency. These interactions exhibit considerable stability under high shear conditions as indicated by the CHSV viscosity increase of 13%, for Examples 4C and 5, and 24%, for Examples 8C and 9, for interactions of the dispersant VI improvers combined with detergent. No viscosity enhancement is observed for the non-functionalized polyolefin viscosity improver. Increases in relative polymer thickening efficiency occur over a range of dispersant VI improver concentrations.

Examples 10C–25C: Dilution Effects for VI/Detergent Premixes

These examples show the effect that additional diluent has on dispersant VI improver/detergent premixes. In these examples, 102.0 g. of indicated VI improver is blended with from 0 to 80 g. of Lubricating Oil A as diluent, followed by blending with from 0 to 12 g. of Detergent A. This premix is blended overnight at about 80° C. to enable complete mixing and interaction between the VI polymer and detergent. The examples without detergent are run for comparison to show Thickening Power enhancement of VI improver/detergent premixes. The viscosity is measured using the previously described procedure and oil solubility observed, with the results and variables given in Table 2.

TABLE I

Examples 1C–9 Viscosity Analysis

| | Additives | | Viscosity | | | | |
|---|---|---|---|---|---|---|---|
| | | | KV | | | | CCS |
| Ex. | Viscosity Improver[a] | Detergent[b] | 40° C. | 100° C. | 150° C. | CHSV | −25° C. |
| 1C | None | None | 19.71 | 3.74 | 1.75 | 1.524 | 2,075 |
| 2C | VI A[c] | None | 61.7 | 10.14 | 4.43 | 3.04 | 3,500 |
| 3C | VI A[c] | A | 62.8 | 10.4 | 4.59 | 3.076 | 3,550 |
| % Viscosity Increase | | | 3% | 4% | 6% | 2% | 4% |
| 4C | VI B[c] | None | 61.4 | 10.07 | — | 3.03 | 3,600 |
| 5 | VI B[c] | A | 72.4 | 11.28 | — | 3.23 | 3,600 |
| % Viscosity Increase | | | 26% | 19% | — | 13% | 0% |
| 6C | VI A | None | 46.84 | 7.97 | 3.83 | 2.743 | 3,200 |
| 7C | VI A | A | 47.78 | 8.09 | 3.61 | 2.596 | 3,250 |
| % Viscosity Increase | | | 3% | 3% | −11% | −12% | 4% |
| 8C | VI B | None | 46.88 | 7.92 | 3.54 | 2.572 | 3,150 |
| 9 | VI B | A | 55.5 | 8.65 | 3.82 | 2.882 | 3,250 |
| % Viscosity Increase | | | 32% | 17% | 16% | 24% | 9% |

Notes to Table 1:

[a]1.1%, unless otherwise indicated

[b]1.7%, unless otherwise indicated

[c]1.5%

TABLE 2

Effect of VI and Oil Dilution on Viscosification

| Ex. | VI | Detergent (g) | Diluent (g) | KV (100° C.) | Oil Solubility (80° C.) | Thickening Power | Viscosity Increase |
|---|---|---|---|---|---|---|---|
| 10C | B | None | None | 1,176 | Soluble | 6.88 | |
| 11 | B | 12 | None | * | Soluble | 7.28 | 6% |
| 12 | B | 6 | None | — | Soluble | 8.19 | 19% |
| 13 | B | 3 | None | — | Soluble | 7.25 | 5% |
| 14C | B | None | 27.7 | — | Soluble | 5.17 | |
| 15 | B | 5.9 | 27.7 | — | Soluble | 5.29 | 2% |
| 16C | B | None | 16.3 | — | Soluble | 5.72 | |
| 17 | B | 4.3 | 16.3 | — | Soluble | 5.64 | −1% |
| 18C | C | None | None | 1,039 | Soluble | 6.71 | |
| 19C | C | 3 | None | * | Insoluble | Insoluble | — |
| 20C | C | None | 20 | 529 | Soluble | 4.75 | |
| 21C | C | 3 | 20 | 3,926 | Poor | 6.55 | 38% |
| 22C | C | None | 40 | 311 | Soluble | 3.62 | |
| 23C | C | 3 | 40 | 1,804 | Soluble | 5.45 | 51% |
| 24C | C | None | 80 | 143 | Soluble | 2.03 | |
| 25C | C | 3 | 80 | 423 | Soluble | 3.10 | 53% |

Note for Table 2:
*to viscous to measure

The results in Table 2 show that the VI Improver/Detergent premixes of this invention can be, and optimally are, used without diluent addition before or during premixing VI improver with detergent. This contrasts with properties of other VI improvers, as shown in Examples 19C and 21C, which may include and/or require the addition of diluent to be soluble. In addition, diluent addition can at least initially result in diminishing or eliminating viscosity enhancement due to premixing VI improver and detergent, as shown in Examples 14C through 17.

Examples 26C–33: VI Polymer/Detergent Premix concentration and Lubricating Oil Variations These examples show that various amounts of VI improver and detergent give lubricant viscosity enhancement. In Examples 28 and 29, 204 g. of a 13% solution of VI Polymer B in Lubricating Oil B is blended with the indicated amount of Detergent A and mixed overnight at 80° C. The resulting premix is a clear, slightly viscoelastic liquid. Example 27 without detergent is given for comparison, as is Example 26 with lubricant oil without either VI improver or detergent. Examples 30 through 33 duplicate Examples 26 through 29, respectively, except that the amount of VI improver is increased to 1.5 weight percent and the lubricating oil replaced with Lubricating Oil D. The viscosities of these compositions are given in Table 3.

TABLE 3

Lubricant Viscosity Analysis

| | Additives | | | Viscosity | | | | |
|---|---|---|---|---|---|---|---|---|
| | | | | KV | | | CHSV | CCS |
| Ex. | VI | Detergent | Lube Oil | 40° C. | 100° C. | 150° C. | 150° C. | −25° C. |
| 26C | None | None | A | 19.71 | 3.74 | — | 1.524 | 2,075 |
| 27C | 1.1% | None | A | 46.88 | 7.92 | 3.54 | 2.572 | 3,150 |
| 28 | 1.1% | 6% | A | 56.79 | 9.19 | — | 2.449 | 2,910 |
| % Viscosity Increase | | | | 27% | 23% | — | — | — |
| 29 | None | 3% | A | 50.46 | 8.38 | — | 2.414 | 2,950 |
| % Viscosity Increase | | | | 12% | 10% | — | — | — |
| 30C | None | None | D | 26.89 | 4.94 | 2.29 | 1.820 | — |
| 31C | 1.5% | None | D | 73.34 | 11.82 | 5.11 | 3.330 | — |
| 32 | 1.5% | 6% | D | 89.85 | 13.94 | 5.47 | 3.294 | — |
| % Viscosity Increase | | | | 26% | 24% | 11% | — | — |
| 33 | 1.5% | 3% | D | 78.92 | 12.58 | 5.25 | 3.478 | — |
| % Viscosity Increase | | | | 11% | 10% | 5% | 9% | — |

The results in Table 3 show that the amount of detergent can vary to as low as 3 weight percent and still provide significant viscosity enhancement. Viscosity enhancement is also shown for different lubricating oils.

Examples 34C–36: Synthetic Lubrication Oils with VI Improver/Detergent Premixes These examples show that VI improver/detergent premixes enhance the viscosity of lubricants containing synthetic lubricating oil. In Example 36, 204 g. of VI Polymer B and 6.0 g. of Detergent A are blended at 80° C. overnight to make a completely blended premix of VI Improver/Detergent. The premix is then added to a synthetic Lubricating Oil C to give a lubricant containing 0.5 weight percent VI improver. Corresponding lubricant composition free of detergent is prepared in Example 35C for comparison, as is Example 34C of lubricating oil alone. The viscosities for these compositions are shown in Table 4.

TABLE 4

| VI Improver/Detergent Premixes in Synthetic Lubricating Oil | | | | | | | |
|---|---|---|---|---|---|---|---|
| | Additives | | Viscosity | | | | |
| | | | KV | | | CHSV | CCS |
| Ex. | VI Polymer | Detergent | 40° C. | 100° C. | 150° C. | 150° C. | −25° C. |
| 34C | None | None | 16.81 | 3.86 | 1.88 | 1.412 | 480 |
| 35C | B | None | 34.70 | 7.13 | 3.33 | 2.160 | 660 |
| 36 | B | 3 wt % | 37.68 | 7.69 | 3.47 | 2.123 | 670 |
| % Viscosity Increase | | | 14% | 15% | 9% | — | — |

The results in Table 4, and as compared with Table 1, show that VI improver/detergent premixing enhances the viscosity of synthetic oil base stocks in addition to mineral oils. As with the mineral oil properties, improvements in higher temperature viscosities are achieved without any significant increase in low temperature viscosity.

Examples 37C–44C: VI/Detergent Premixes with Different Detergents

These examples show that lubricants using a variety of detergents have enhanced viscosity properties. In Examples 38 through 44, 100 g. of a 13% solution of VI Polymer B in Lubricating Oil B and 3.0 g. of the designated detergent are mixed at 80° C. for 1 hour until completely blended. The mixture is kept at 60° C. for a week, providing an opportunity for intimate contact between the detergent and the viscosity index improver and allowing any interaction which may occur to proceed to completion. A solution of 11.5% of the VI polymer/detergent premix is then prepared in Lubricating Oil B, with mixing at 55° C. for 1 hour ensuring complete mixing. In Example 37C, detergent is omitted for comparison. The viscosities for these compositions are shown in Table 5.

TABLE 5

| VI Improver/Detergent Premixes with Various Detergent | | | |
|---|---|---|---|
| Example | Detergent | Viscosity KV, 100° C. | Thickening Power |
| 37C | None | 10.79 | 6.67 |
| 38 | A | 11.15 | 7.03 |
| 39 | B | 10.76 | 6.64 |
| 40 | D | 11.21 | 7.09 |
| 41 | F | 11.77 | 7.65 |
| 42C | C | 10.40 | 6.28 |
| 43C | E | 10.25 | 6.13 |
| 44C | G | 10.02 | 5.90 |

The results show that viscosity enhancement can vary depending upon the particular detergent. Detergents A, D and F give enhanced viscosification properties relative to the VI improver only solution in Example 37C. Detergents C, E and G give a reduction in viscosification when blended with VI Improver B. Detergent B does not significantly change the viscosity indicating some enhanced viscosification which is offset by dilution effect.

Examples 45–59: Detergent Concentration Effects on Lubricant Viscosity

These examples show that enhanced lubricant composition viscosity is achieved over a wide range of detergent concentrations. In Examples 45–51, 102 g. of a 13% solution of VI Polymer B in Lubricant Oil B is mixed with various amounts of Detergent A and blended at 80° C. for 1 hour and stored at 80° C. for 5 days to allow for complete interaction between the detergent and the VI improver. These concentrated preblends are diluted to solutions containing 1.1% of VI Polymer B in Lubricating Oil A. For comparison, these Examples are repeated in Examples 52C–59C using a non-dispersant VI improver of VI Polymer A, in place of VI Polymer B. The viscosities for these solutions are shown in Table 6.

TABLE 6

| Detergent Concentration Effects of VI Improver/Detergent Premix Viscosification | | | | | | |
|---|---|---|---|---|---|---|
| | Premix | | Viscosity | | | |
| | VI | Detergent | KV | | CHSV | CCS |
| Ex. | Improver | A | 40° C. | 100° C. | 150° C. | −25° C. |
| 45 | B | None | 46.38 | 7.87 | 2.438 | 3,050 |
| 46 | B | 1.5 g. | 48.18 | 8.12 | 2.416 | 3,050 |
| 47 | B | 2.0 g. | 49.00 | 8.24 | 2.459 | 3,100 |
| 48 | B | 2.5 g. | 50.10 | 8.41 | 2.513 | 3,100 |
| 49 | B | 3.0 g. | 50.90 | 8.51 | 2.481 | 3,050 |
| 50 | B | 6.0 g. | 56.90 | 9.35 | 2.531 | 3,050 |
| 51 | B | 12.0 g. | 52.00 | 8.61 | 2.560 | 3,100 |
| 52C | A | None | 45.98 | 7.84 | 2.585 | 3,150 |
| 53C | A | 1.5 g. | 46.04 | 7.84 | 2.486 | 3,150 |
| 54C | A | 2.0 g. | 46.13 | 7.86 | 2.455 | 3,100 |
| 55C | A | 2.5 g. | 46.11 | 7.85 | 2.438 | 3,150 |
| 56C | A | 3.0 g. | 46.00 | 7.84 | 2.477 | 3,150 |
| 57C | A | 6.0 g. | 46.17 | 7.85 | 2.486 | 3,200 |
| 58C | A | 12.0 g. | 46.63 | 7.92 | 2.489 | 3,200 |
| 59C | A | 20.4 g. | 46.51 | 7.97 | 2.479 | 3,300 |

The results in Table 6 show that enhanced viscosification of lubricant compositions is achieved using VI improver/detergent premixes over a range of detergent concentrations. The results also show that measurable viscosity enhancement is shown for all detergent concentrations, with a leveling off in viscosity enhancement in these examples, at a detergent/VI polymer ratio of about 0.8%. Higher concentrations of detergent generally do not provide significant additional increases in viscosity enhancement and in some cases would be undesirable if excess detergent is used resulting in undesirable viscosity increases during storage. No enhancement in viscosification properties is obtained for non-functionalized VI improver.

Description of Figures

Figure 2:
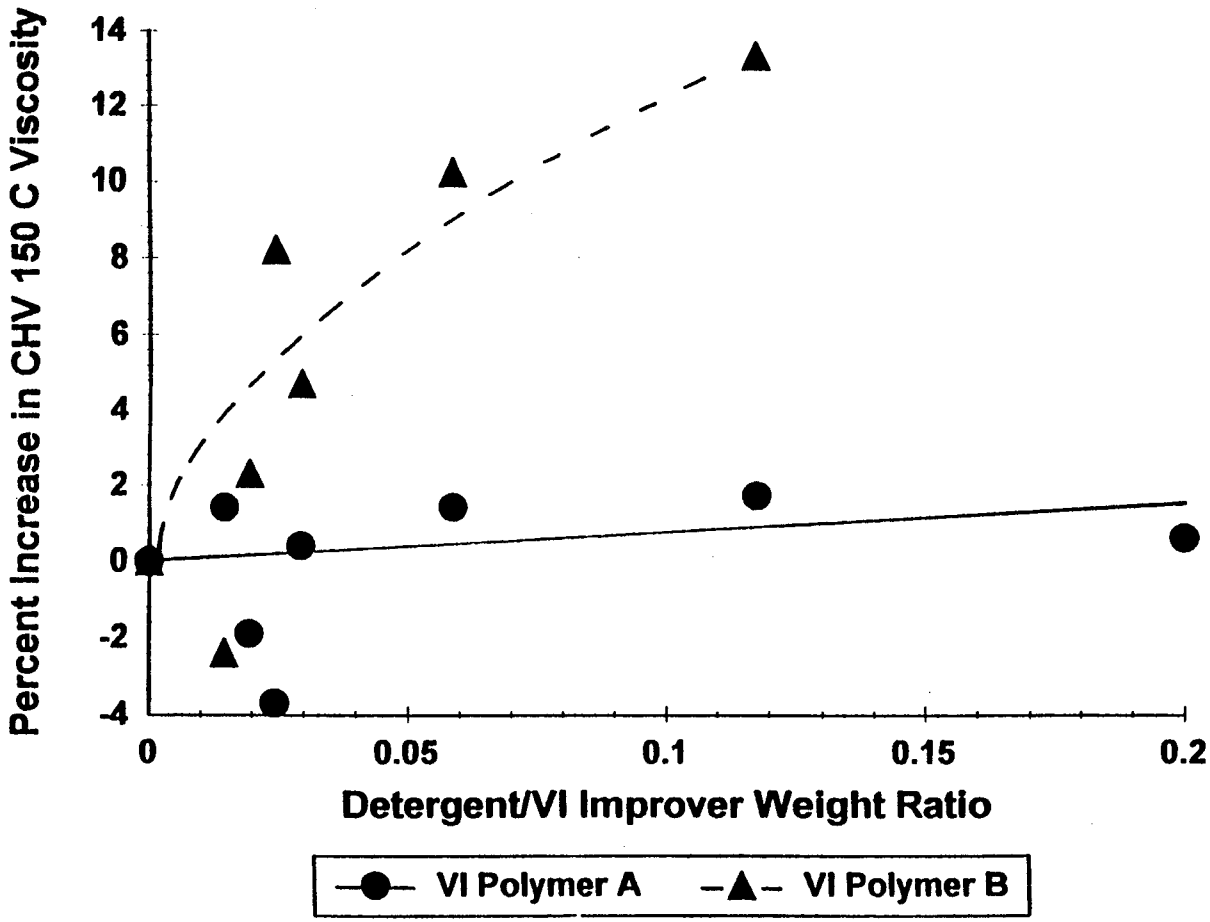
Figure 3:
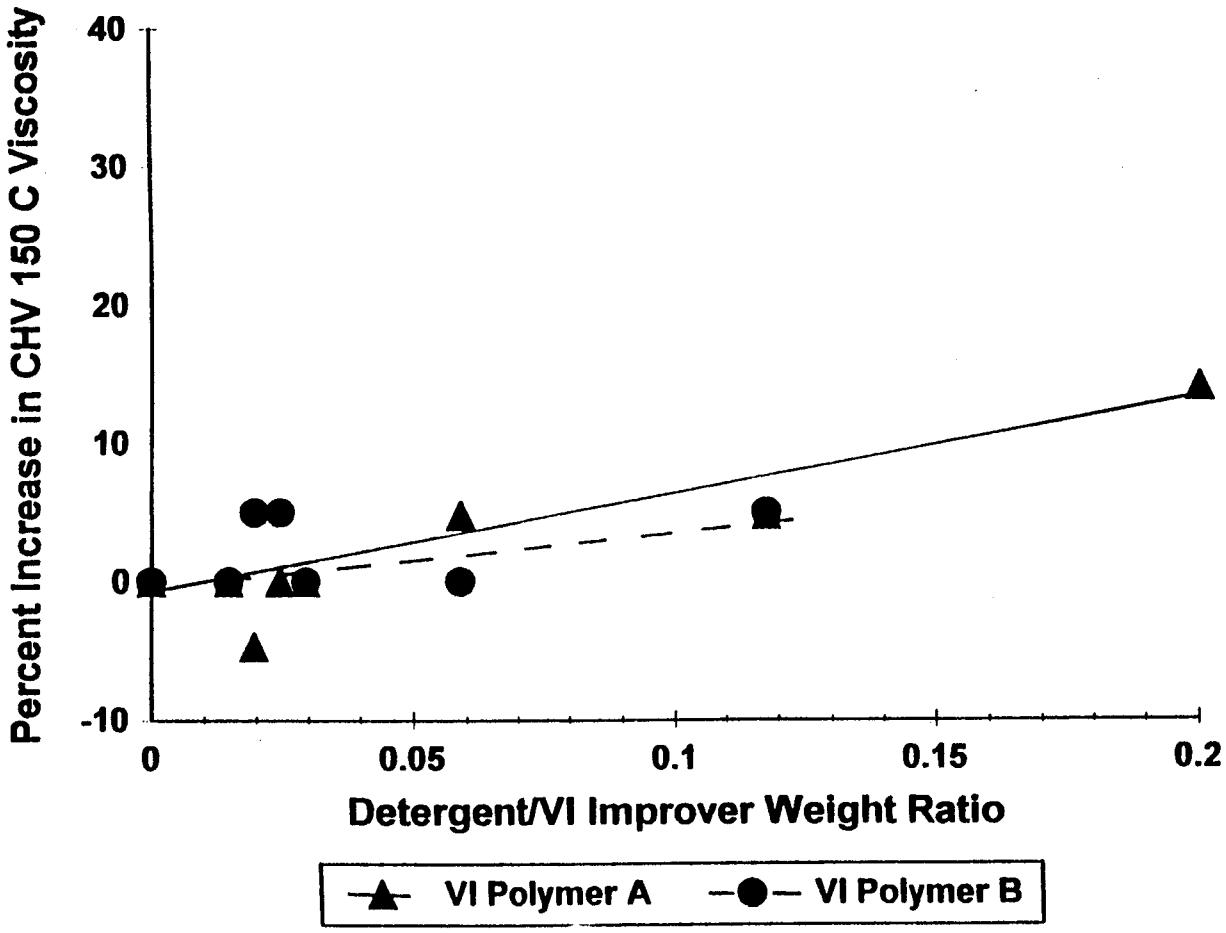

FIGS. 1 through 3 show the properties, in graphic form, of detergent/VI improver premixes of this invention, and how such properties vary depending upon the type and amount of VI improver, detergent and dispersant.

More particularly, FIG. 1 plots the increase in kinematic viscosity, measured at 100° C., against the weight ratio of detergent to VI improver, for 8.5 weight percent VI improver, which is a 13 weight percent solution of VI polymer in Lubricating Oil A. The kinematic viscosities are measured over a range in weight ratio of detergent to VI improver for both dispersant VI polymer as compared with nondispersant VI polymer. The ratio of the kinematic viscosity of the compositions containing detergent/VI improver over the same composition without detergent is determined in terms of percent increase. The increases in kinematic viscosity are plotted along the ordinate or vertical axis of the graph with the weight ratio of detergent to VI improver plotted along the abscissa or horizontal axis. There is a large difference in viscosity performance between the two types of VI polymers. The addition of small amounts of detergent, from 1 to 5 weight percent, gives increases in kinematic viscosity of up to about 60 percent for the dispersant VI polymer. The nominal increase in kinematic viscosity for the nondispersant VI polymer may simply be the result of added detergent as distinct from any interaction between detergent and the VI polymer. The graph shows a significant increase in kinematic viscosity with the addition of detergent.

FIG. 2 is similar to FIG. 1 except that the data shown is for Cannon High Shear viscosity, measured at 150° C., instead of kinematic viscosity. The results are similar to those in FIG. 1 in that substantial increases in relative viscosity are observed for the dispersant VI polymer only. In this case, kinematic viscosity increases with the initial addition of detergent and levels off at higher detergent concentrations. This kind of performance is consistent with detergent/VI polymer interaction up to a maximum which may correspond to the total number of available sites for interaction between the polymer and detergent, such that the further addition of detergent does not provide any further increase in detergent-/VI polymer interaction. This performance demonstrates the detergent/VI polymer interactions are maintained under high shear conditions, suggesting that such interactions are of a chemical rather than a physical nature.

FIG. 3 is similar to FIG. 1 except that the Cold Cranking Simulator (CCS) viscosity, measured at −25° C. is given instead of kinematic viscosity. The results show that there is no low temperature viscosity increase for dispersant VI polymers as compared to a gradual increase in viscosity for nondispersant VI polymer.

We claim:

1. A process for making a lubricant composition by:

(1) combining:

(a) dispersant viscosity index improver, which is a polyolefin of ethylene, $C_{3-20}$ α-monoolefin, and optionally polyene, having a number average molecular weight of at least about 10,000, which is grafted with ethylenically unsaturated, nitrogen-containing, heterocyclic compound, with;

(b) detergent, which is an overbased, oil-soluble, calcium sulfonate which interacts with the viscosity index improver to give increased lubricant viscosity at high temperatures; to make a premix, followed by;

(2) combining the premix with lubricating oil and dispersant package to make a lubricant composition with enhanced viscosification.

2. The process of claim 1 wherein the viscosity index improver has a repeating structure represented by the formula:

$$(-CH_2CH_2-)_a(-\overset{\overset{R}{|}}{C}HCH_2-)_b(-\overset{\overset{R_{ene}}{|}}{C}HCH_2-)_c(-\overset{\overset{R'}{|}}{C}H\overset{\overset{R_g}{|}}{C}H-)_d$$

wherein:

a is from about 15 to about 85 mole percent;

b is from about 15 to about 85 mole percent;

is from 0 to about 15 mole percent;

d is from about 0.1 to about 15 mole percent;

each R is independently $C_{1-18}$ alkyl;

each $R_{ene}$ is independently $C_{2-30}$ hydrocarbenyl;

each R' is independently hydrogen, R or $R_{ene}$; and each $R_g$ is independently a N-heterocyclic substituted, aminoalkylene.

3. The process of claim 2 wherein is an N-pyrrolidonyl aminoethylene group.

4. The process of claim 1 wherein the detergent has a structure represented by the formula:

$$(M^{+\nu}(OH)_\nu)_m(M_{3-\nu}{}^{+\nu}CO_3{}^{=})_n(M^{+\nu}Y_\nu{}^{-})$$

wherein:

$M^{+\nu}$ is calcium;

v is the valence of M of 2;

$Y^-$ is an oil-soluble, sulfonate anion; and m+n is more than 0.5.

5. The process of claim 4 wherein a mixture of monoalkylaryl and dialkylbenzene m+n is from about 8 to about 12.

6. The process of claim 1 wherein the premix is made in step (1) without the addition of diluent.

7. The composition of claim 1 wherein the lubricant composition has a significantly increased kinematic and/or high shear viscosity as compared with the same lubricant composition made without precombining the viscosity index polymer and detergent in step (1).

8. The composition of claim 7 wherein the viscosity index improver has a repeating structure represented by the formula:

$$(-CH_2CH_2-)_a(-\overset{\overset{R}{|}}{C}HCH_2-)_b(-\overset{\overset{R_{ene}}{|}}{C}HCH_2-)_c(-\overset{\overset{R'}{|}}{C}H\overset{\overset{R_g}{|}}{C}H-)_d$$

wherein:

a is from about 15 to about 85 mole percent;

b is from about 15 to about 85 mole percent;

c is from 0 to about 15 mole percent;

d is from about 0.1 to about 15 mole percent;

each R is independently $C_{1-18}$ alkyl;

each $R_{ene}$ is independently $C_{2-30}$ hydrocarbenyl;

each R' is independently hydrogen, R or $R_{ene}$; and each $R_g$ is independently a N-heterocyclic substituted, aminoalkylene.

9. The composition of claim 2 wherein $R_g$ is an N-pyrrolidonyl aminoethylene group.

10. The composition of claim 7 wherein the detergent has a structure represented by the formula:

$$(M^{+\nu}(OH)_\nu)_m(M_{3-\nu}{}^{+\nu}CO_3{}^{=})_n(M^{+\nu}Y_\nu{}^{-})$$

wherein:

$M^{+\nu}$ is an calcium;

v is the valence of M of 2;

$Y^-$ is an oil-soluble sulfonate anion; and m+n is more than 0.5.

11. The composition of claim 10 wherein Y is a mixture of monoalkylaryl and dialkylbenzene sulfonate, and m+m is from about 8 to about 12.

* * * * *